US006296533B1

(12) United States Patent
Grubbs et al.

(10) Patent No.: US 6,296,533 B1
(45) Date of Patent: Oct. 2, 2001

(54) ELECTRICAL RECEPTACLE CONTACT

(75) Inventors: Jimmy Glenn Grubbs, Walkertown; David Maurice Wolla, Winston-Salem; Michael Henry Banas, Kernersville, all of NC (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/144,130

(22) Filed: Aug. 31, 1998

(51) Int. Cl.[7] ..... H01R 13/11
(52) U.S. Cl. ..... 439/851; 439/857
(58) Field of Search ..... 439/851, 856, 439/857

(56) References Cited

U.S. PATENT DOCUMENTS

| | | | | |
|---|---|---|---|---|
| 5,067,916 | * | 11/1991 | Denlinger et al. | 439/857 |
| 5,106,329 | * | 4/1992 | Maeshima | 439/856 |
| 5,256,088 | * | 10/1993 | Lu et al. | 439/856 |
| 5,307,562 | | 5/1994 | Denlinger et al. | 29/882 |
| 5,322,459 | * | 6/1994 | Spinnato | 439/843 |
| 5,458,513 | * | 10/1995 | Matsuoka | 439/857 |
| 5,462,459 | * | 10/1995 | Childs | 439/856 |
| 5,599,212 | * | 2/1997 | Sawada | 439/852 |
| 5,749,755 | * | 5/1998 | Genta et al. | 439/856 |
| 5,797,774 | * | 8/1998 | Kaneko | 439/857 |

FOREIGN PATENT DOCUMENTS

| | | | |
|---|---|---|---|
| 0 512 207 A1 | 11/1992 | (EP) | H01R/13/28 |
| WO 95/11531 | 4/1995 | (WO) | H01R/13/115 |

OTHER PUBLICATIONS

European Search Report, Application No. EP 99 30 6901.

* cited by examiner

*Primary Examiner*—Renee Luebke
*Assistant Examiner*—Briggitte R Hammond

(57) ABSTRACT

An electrical receptacle contact is provided having contact beams which are asymmetrically opposed, defining a terminal receiving section therebetween. Asymmetrically opposed contact beams may have various widths to provide an appropriate spring force for a selected plating material, while ensuring that the receptacle contact maintains the same overall dimensional shape as contacts made with a different plating material. Although allowing for variable spring rate in limited dimensioned contact, susceptibility of fracture of the contact of the present invention during forming is minimized.

13 Claims, 5 Drawing Sheets

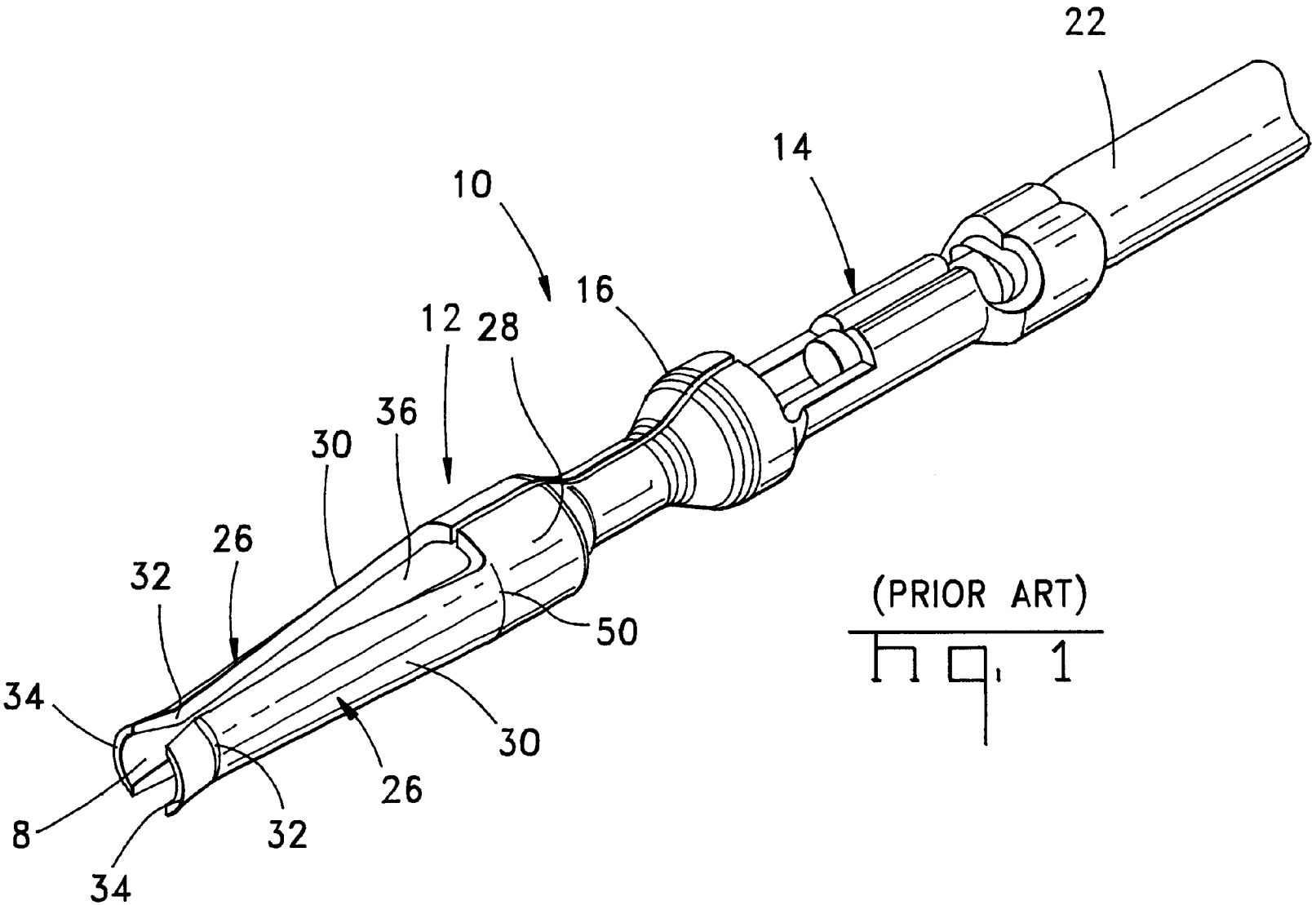
(PRIOR ART) FIG. 1

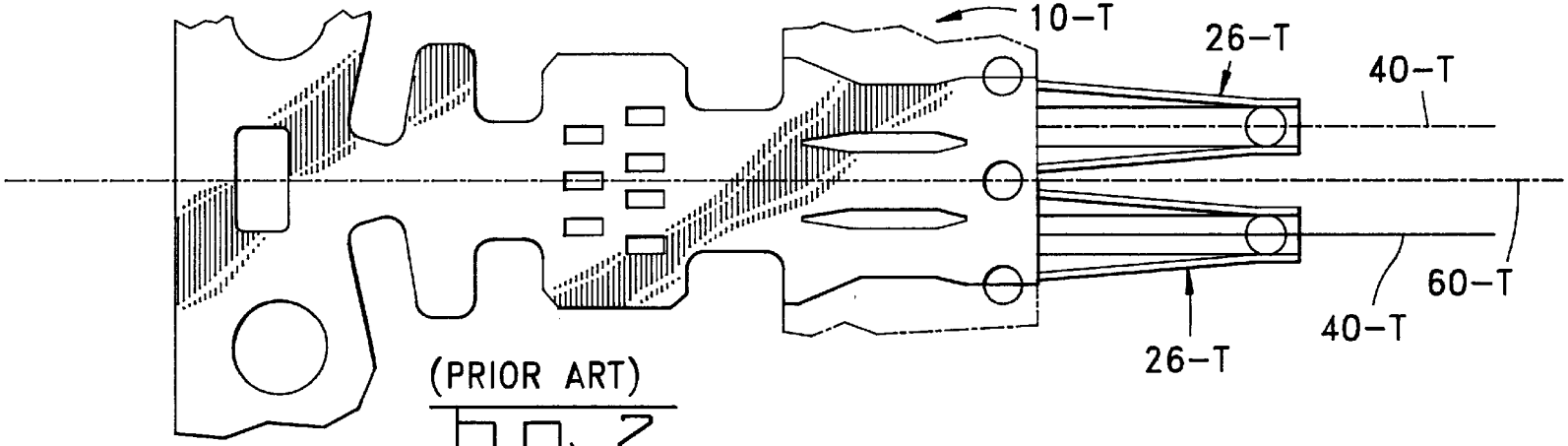
(PRIOR ART) FIG. 2
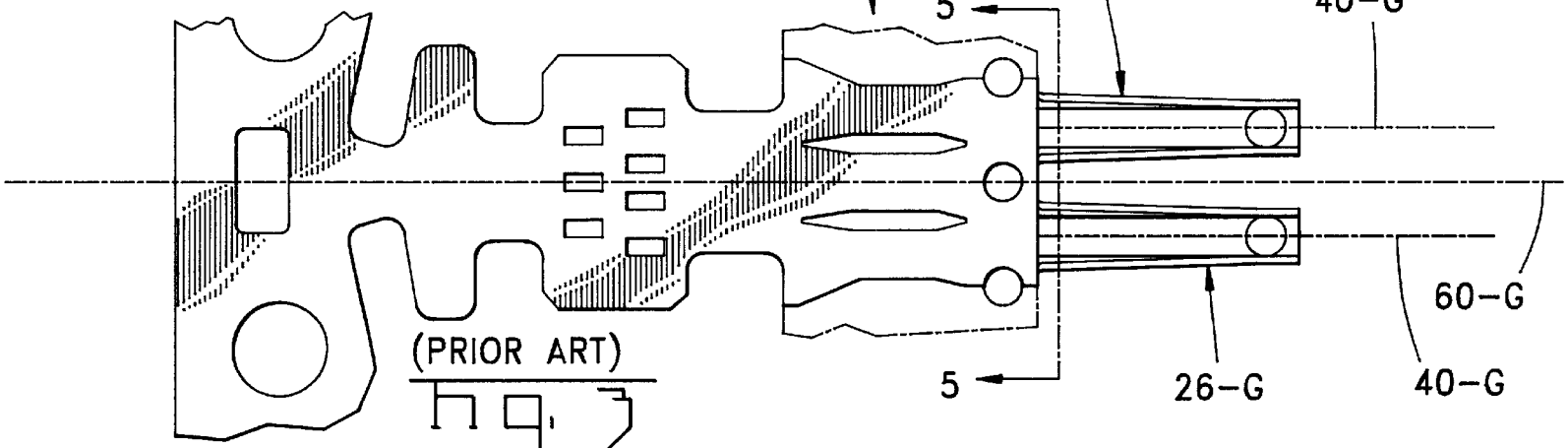
(PRIOR ART) FIG. 7

(PRIOR ART)
Fig. 6
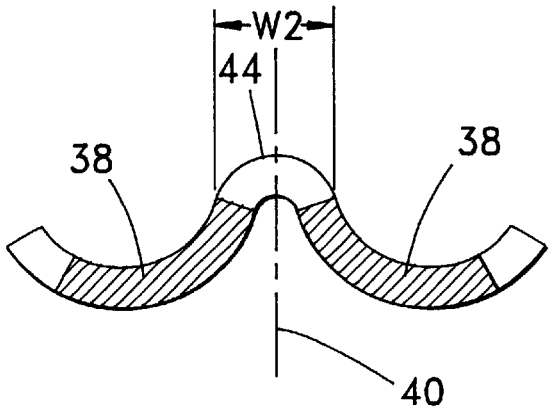
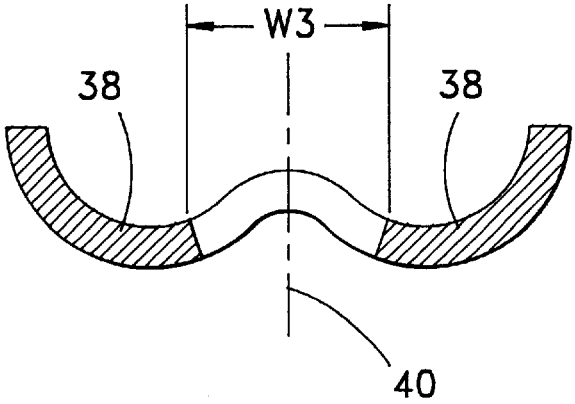
Fig. 7
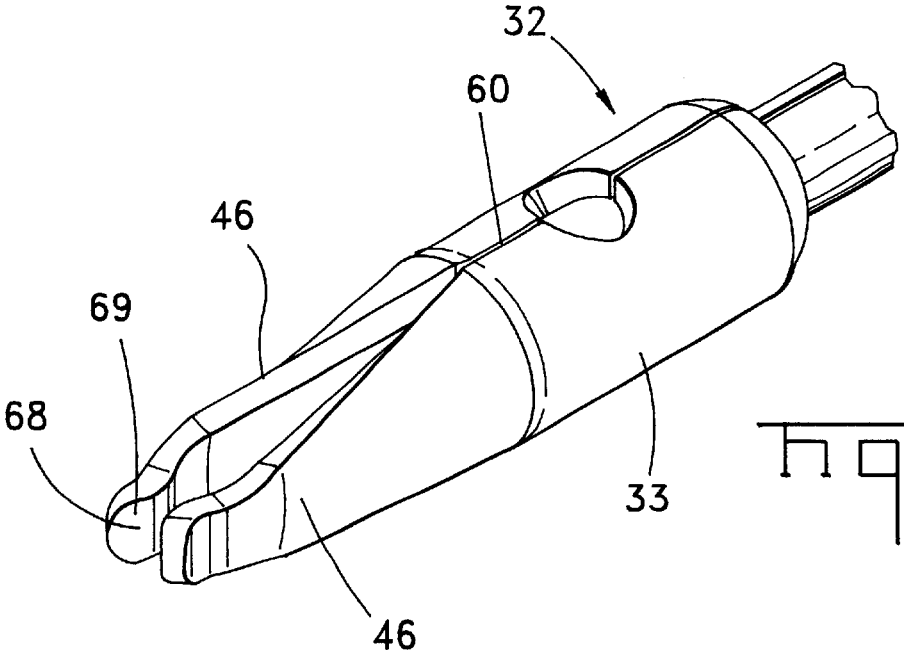
Fig. 8

ELECTRICAL RECEPTACLE CONTACT

FIELD OF THE INVENTION

The present invention relates to electrical contacts having a spring rate which can be varied without changing the overall dimensional shape of the contact.

BACKGROUND OF THE INVENTION

Electrical receptacle contacts of the type having opposing resilient contact beams designed for receiving contact pins are well known in the art. Typically, these electrical receptacle contacts may be gold plated or tin plated and therefore require the contact beams to provide various spring rates in order to produce consistent electrical performance. And, although different plating materials are employed which require contact beams of varying stiffness to impart different levels of force on contact pins, frequently, the overall dimensional shape of the contact must remain constant no matter what plating material is employed.

U.S. Pat. No. 5,067,916 discloses a method of making electrical receptacle contacts using various plating materials while providing sufficient spring forces for each respective plated contact and maintaining a constant overall dimensional shape of the receptacle. Thus an electrical receptacle contact of a given length plated with tin will produce the same electrical performance as a gold plated electrical receptacle contact of the same given length. Receptacle contacts such as the one disclosed in U.S. Pat. No. 5,067,916 utilize a common design having two symmetrically opposed contact arms. Rather than vary the length of the contact arm, the width and angles of the arms are adjusted to obtain appropriate spring forces while maintaining a constant overall dimensional shape.

As the width of the contact arm increases however, problems arise in forming the contact. In order to achieve a proper cylindrical structure, a stamped contact blank must undergo reverse bending in an area between each contact arm. As the contact arm width increases to impart the appropriate spring rate to the receptacle, the area between the contact arms decreases, thereby creating a relatively sharp edge between the contact arms during reverse bending rather than a desired rounded "W" shape. The sharp edge produced during reverse bending increases the likelihood of fracture of the receptacle during forming.

This reverse bending technique is necessary because alternative forming methods do not provide a uniform transition between the contact arms and the body of the contact by matching the forming radii of each. A uniform transition provided by reverse bending prevents thinning, flattening and fracturing which would adversely effect spring rate and spring forces.

Accordingly, what are needed are electrical receptacle contacts of constant overall dimensional shape which can provide a variety of spring forces accommodating different plating materials.

SUMMARY OF THE INVENTION

The present invention provides an electrical receptacle contact having a conductor receiving section and a receptacle section. The receptacle section has two resilient contact beams which terminate at free ends. The contact beams are disposed asymmetrically opposite one another, thereby forming a terminal receiving cavity. An intermediate section is also provided for joining the receptacle section to the conductor receiving section.

A stamped and formed electrical receptacle contact is provided having a conductor receiving section, a receptacle section defined by two contact beams, and an intermediate section between the conductor receiving section and the receptacle section. The intermediate section is a cylinder with a lengthwise seam, and the contact beams extend outwardly from the intermediate section and are disposed on each side of the seam. The beams are asymmetrically opposed in an orientation closest the seam.

BRIEF DESCRIPTION OF THE DRAWINGS

An embodiment of the present invention will now be described in detail with reference to the accompanying drawings, in which:

FIG. 1 is an isometric view of a prior art electrical receptacle contact;

FIGS. 2 and 3 are top views of prior art electrical receptacle contact blanks plated with tin and gold, respectively;

FIG. 6 is a cross-sectional end view of an electrical receptacle contact during forming;

FIG. 7 is a cross-sectional end view of the electrical receptacle contact of the present invention during forming;

FIG. 8 is an isometric view of the receptacle section of the present invention after forming;

DETAILED DESCRIPTION OF THE INVENTION

Figure 4:
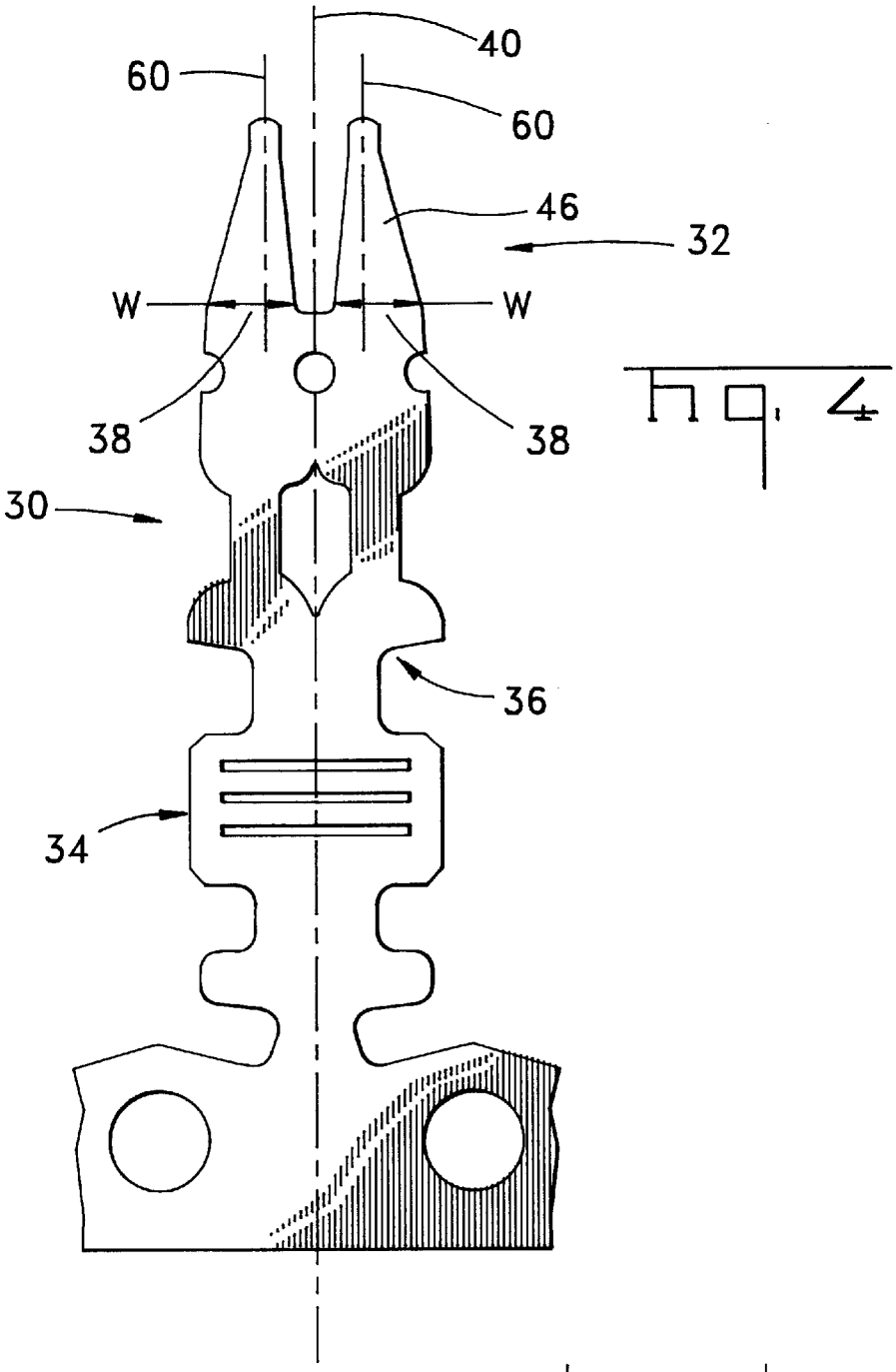
FIG. 4 is a top view of the electrical receptacle contact blank of the present invention.

Prior art FIG. 1 shows a known electrical receptacle contact 10 having a wire connection section 14, an intermediate section 16 and a receptacle section 12. The receptacle section 12 has contact arms in the form of symmetrically opposed cantilever beams 26 positioned to receive a pin contact (not shown) in a terminal receiving section 8. Prior art FIGS. 2 and 3 show contact blanks 10-T and 10-G, respectively. Contact blank 10-T shown in FIG. 2 is tin plated and has wider beams 26-T than the gold plated contact beams 26-G of FIG. 3. Both beams 26-T and 26-G are symmetrically disposed about respective center lines 40-T and 40-G. Additionally, beams 26-T and 26-G of FIGS. 2 and 3, respectively are symmetric about beam center lines 60-T and 60-G.

FIG. 4 shows contact blank 30 of the present invention having a wire connection section 34 an intermediate section 36 and a receptacle section 32 having contact beams 46. Contact beams 46 are symmetrically disposed about contact blank center line 40 in a similar manner to prior art receptacle contacts shown in FIGS. 2 and 3. However, contact beams 46 are asymmetrically disposed about contact beam center lines 60. That is, the width of contact beams 46 at base portions 38 is greater on each side of contact beams center lines 60 furthest from contact center line 40. The overall width W of each contact beam 46 may be varied to obtain the appropriate spring rate necessitated by various plating materials by adjusting the width of the contact beam 46 on the sides furthest from contact blank center line 40.

Figure 5:
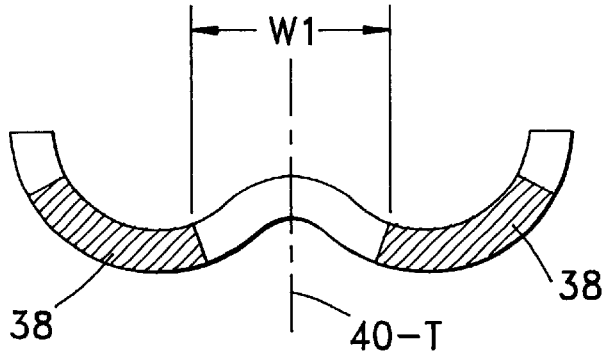
(PRIOR ART) Fig. 5
FIG. 5 is a cross-sectional end view of a prior art electrical receptacle contact during forming taken from FIG. 3.

FIG. 5 is a cross sectional end view taken from FIG. 3 of a prior art electrical receptacle contact blank during forming, in which the blank is undergoing reverse bending prior to forming the contact into its final cylindrical shape. Distance W1 indicates the width between the base portions of the contact beams. FIG. 6 shows that as the contact beams 26 of FIG. 5 are widened symmetrically about their beam center lines 60, base portions 38 approach one another at contact center line 40, thereby decreasing the width between the contact arms to distance W2. The convergence of base portions 38 create a relatively sharp edge 44 which increases the probability of fracture during reverse bending. It is an object of the present invention to maintain a distance W3 between base portions of contact beams while widening the contact beams on their sides furthest from contact blank center line 40, as best shown in FIG. 7. As illustrated, distance W3 is near or equal to distance W1 of FIG. 5, while the contact beam width has been significantly increased to provide an adequate spring rate.

Figure 9:
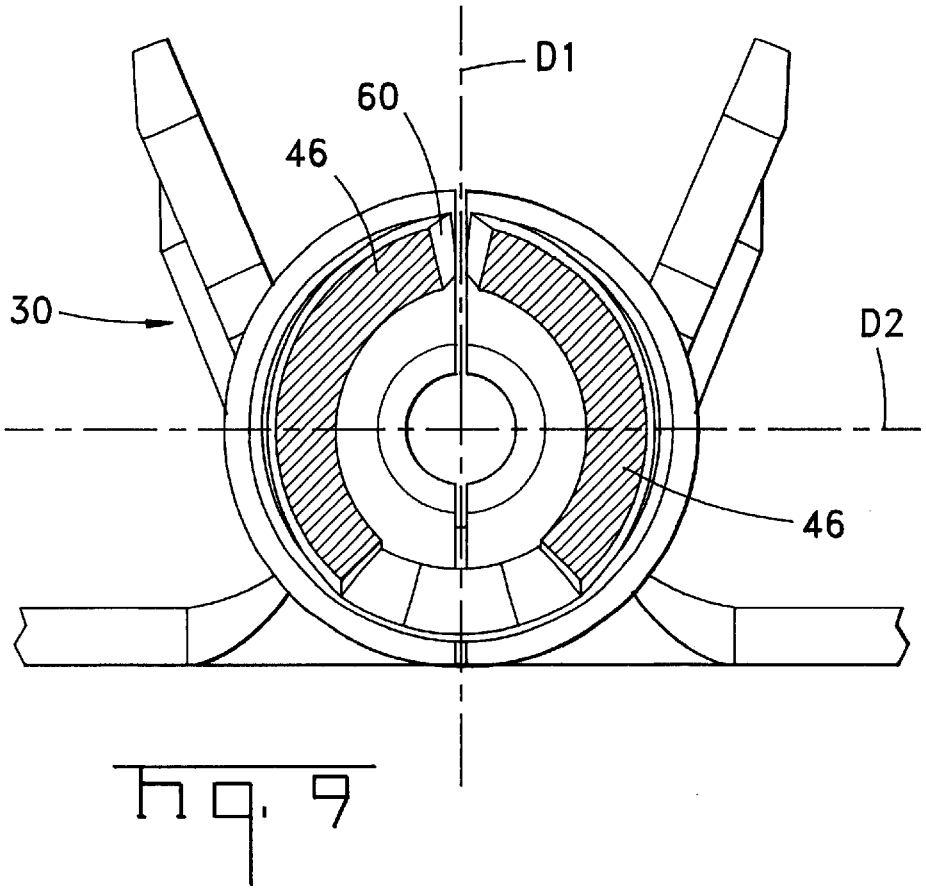
FIG. 9 is a cross-sectional end view of the electrical receptacle contact of the present invention after forming.

FIG. 8 shows an electrical receptacle contact of the present invention after forming is completed. As shown, contact beams 46 are oppositely disposed about seam 70 for receiving a contact pin (not shown) in terminal receiving section 68. FIG. 9 shows a cross sectional end view of the electrical receptacle contact 30 of the present invention. As shown, a vertical diameter is projected through seam 70 thereby defining a vertical contact center line D1. A horizontal diameter projected through the receptacle is drawn perpendicular to vertical contact center line, thereby defining a horizontal contact center line D2. Each contact beam 46 is shown asymmetrically disposed about horizontal contact center line D2, illustrating that the contact beam width is adjusted on the seam side of the electrical receptacle contact only.

Figure 10:
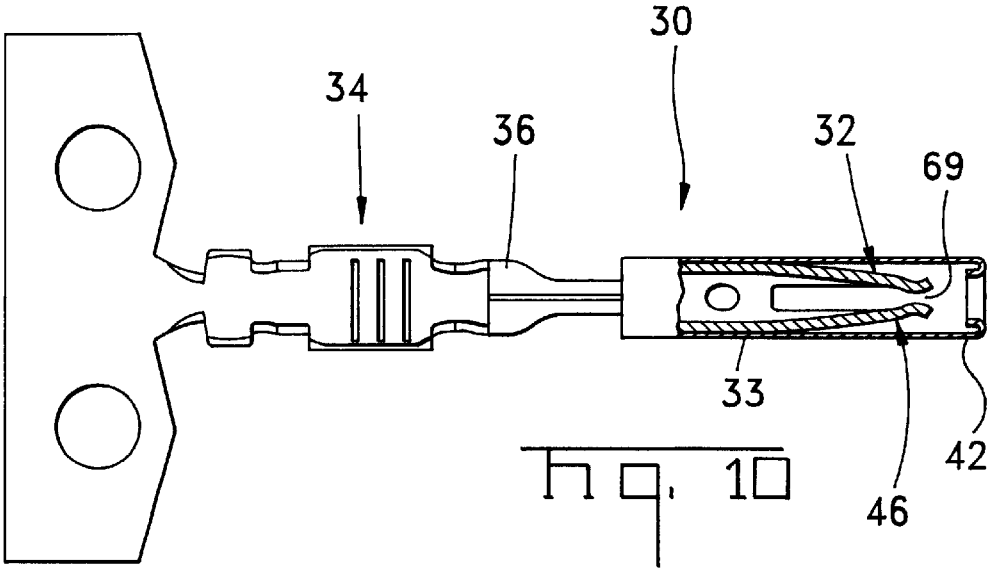
FIG. 10 is top view of the electrical receptacle contact of the present invention showing a protective sleeve.

FIG. 10 shows an embodiment of the present invention having a wire connection section 34 in the form of a U shape crimping area. Additionally, the electrical receptacle contact is fitted with a cylindrical protective sleeve 42 around a barrel portion 33 of receptacle section 32 extending the length of receptacle section 32. Certainly, however, various crimping section shapes and numerous variations of protective sleeves should be apparent from the foregoing disclosure. Similarly, the intermediate section could easily be adapted to other configurations not shown. Also, minor variations to the opposed contact beams shown in the drawings, such as flared lead-in surfaces 69, should be obvious from the described invention.

An advantage of the present invention is that an electrical receptacle contact is provided with contact beams that can be adjusted to impart appropriate spring forces for various plating materials while maintaining the constant overall dimensional shape.

Another advantage of the present invention is that while the electrical receptacle contact may be adjusted for various spring strengths, susceptibility to fracture during forming is minimized.

Another advantage of the present invention is that an electrical receptacle contact is provided with adjustable spring rate that may be manufactured using existing forming techniques used to produce prior art receptacle contacts.

The electrical receptacle contact of the present invention and many of its attendant advantages will be understood from the foregoing description. It is apparent that changes may be made in the form, construction, and arrangement of parts thereof without departing from the spirit of the invention, or sacrificing all of its material advantages. Thus, while a present embodiment of the invention has been disclosed, it is to be understood that the invention is not strictly limited to such embodiment but may be otherwise variously embodied and practiced within the scope of the appended claims.

What is claimed is:

1. An electrical contact comprising:

a conductor receiving section;

a receptacle section having two resilient contact beams symmetrically disposed opposite one another about a vertical contact center line thereby forming a terminal receiving cavity, wherein each contact beams asymmetrically disposed about a horizontal contact centerline which is perpendicular to the vertical contact centerline and which intersects the vertical contact center line at a central axis of the electrical contact; and an intermediate section joining the receptacle section to the conductor receiving section, wherein each contact beam is inwardly tapered from a base section toward a contact free end so that the base section of each contact beam adjacent the intermediate section is wider than the beam free end spaced from the intermediate section.

2. The electrical contact of claim 1, wherein the conductor receiving section is a U-shaped crimping section for receiving a conductor to be crimped therein.

3. The electrical contact of claim 1, wherein the contact beams are cantilevered and have an arcuate cross-section.

4. The electrical contact of claim 1, further comprising a sleeve disposed about the contact beams.

5. The electrical contact of claim 1, wherein the receptacle section has a barrel portion connected to the intermediate section and extending to base portions of the contact beams.

6. The electrical contact of claim 5, wherein the contact is stamped and formed resulting in a seam which travels a top length of the contact between the conductor receiving section and the base portions of the contact beams.

7. The electrical contact of claim 6, wherein the vertical contact center line extends along the seam and the base portions of the contact beams are disposed facing one another on each side of the seam with a greater area of the base portions located on a seam side of the horizontal contact center line.

8. A stamped and formed electrical receptacle contact comprising:

a conductor receiving section;

a receptacle section defined by two contact beams; and an intermediate section between the conductor receiving section and the receptacle section, wherein the intermediate section is a cylinder with a lengthwise seam, and wherein the contact beams extend outwardly from the intermediate section and are disposed on each side of the seam, the beams further being asymmetrically oriented along a horizontal center line which is perpendicular to the seam, such that the beams are predominately disposed on a seam side of the horizontal center line, wherein each contact beam is inwardly tapered from a base section toward a contact free end so that the base section of each contact beam adjacent the intermediate section is wider than the beam free end spaced from the intermediate section.

9. The electrical contact of claim 8, wherein the contact beams are cantilevered and have arcuate cross-sections.

10. The electrical contact of claim 8, wherein the conductor receiving section is a U-shaped crimping section.

11. The electrical contact of claim 8, further comprising a sleeve disposed about the contact beams.

12. The electrical contact of claim 8, wherein the contact beams have angled lead-in surfaces.

13. A tin plated stamped and formed electrical contact, formed as one piece from a flat blank, comprising:

a conductor receiving section; and two opposed resilient cantilever beams extending from a cylindrical intermediate section located between the conductor receiving section and the opposed cantilever beams, opposed edges of the cylindrical intermediate section forming a seam extending longitudinally, each cantilever beam having a contact centerline extending centrally through free ends of the beam, each contact beam being tapered from adjacent the free end toward a relatively wider base section adjacent to the cylindrical intermediate section; a portion of each beam base section between the contact centerline and the cylindrical intermediate section seam being wider than an opposite portion of each beam base section on an opposite side of the contact centerline so that a space between the two beams can be large enough to prevent fracture as the cylindrical intermediate section is formed from a flat blank into a generally cylindrical electrical contact.

* * * * *